US005316342A

United States Patent [19]

Almo

[11] Patent Number: 5,316,342

[45] Date of Patent: May 31, 1994

[54] CALENDAR

[76] Inventor: Victor Almo, 219 E. 65th St., Kansas City, Mo. 64113

[21] Appl. No.: 24,664

[22] Filed: Mar. 1, 1993

[51] Int. Cl.[5] ..... B42D 5/04

[52] U.S. Cl. ..... 283/2; 40/107; D19/20

[58] Field of Search ..... 283/2, 3, 4; 40/107, 40/110; D19/20, 23, 24, 25

[56] References Cited

U.S. PATENT DOCUMENTS

| | | | |
|---|---|---|---|
| 2,068,214 | 1/1937 | Winford | 283/2 |
| 2,263,528 | 11/1941 | Wissman | 283/2 |
| 2,560,766 | 7/1951 | Holland | 283/2 |
| 4,798,402 | 1/1989 | Pazicni | 283/4 X |
| 4,947,564 | 8/1990 | Reece et al. | 283/2 |
| 5,016,917 | 5/1991 | Dubnerc et al. | 283/4 |

*Primary Examiner*—Mark Rosenbaum
*Assistant Examiner*—Willmon Fridie, Jr.
*Attorney, Agent, or Firm*—Hovey, Williams, Timmons & Collins

[57] ABSTRACT

A calendar includes at least twelve pages of a printing material, with each page being provided with a calendar field filled with a series of numbered spaces arranged to indicate the days of a particular month in the Gregorian calendar, and a title field provided with alphabetical indicia indicative of the month represented in the calendar field. A display field is also provided on each page and includes one or more graphical symbols of an event which occurs within the month represented in the calendar field, as is a plain, original artwork field which covers at least one half of the area of each page within which alphanumeric and graphical symbols may be drawn by an art student.

6 Claims, 1 Drawing Sheet

CALENDAR

BACKGROUND OF THE INVENTION

1. Field of the Invention

The present invention relates generally to art instruction aids and, more particularly, to a calendar that a child art student can complete throughout a calendar year and display on a refrigerator.

2. Discussion of the Prior Art

Children frequently prepare drawings and art projects at school or day care, and bring the finished works home to their families in order to receive praise and positive reinforcement for the artistic progress being made at school.

Frequently, these works of art are displayed on the home refrigerator until the child brings home later works to replace the earlier ones. Unfortunately, there is no convenient way to preserve the child's artwork in a manner which enables the child to review the work subsequently in order to gauge his or her own progress over the course of one or more years. In addition, because many works produced by children are made away from the home, it is difficult for a child's parents or family to know what model was used by the child in creating the work. Thus, it is difficult for the child's peers to identify the positive improvements made by the child over previous efforts, or to make suggestions to the child for improvements.

OBJECTS AND SUMMARY OF THE INVENTION

It is an object of the present invention to provide a calendar that furnishes a child with both a model picture and a space within which the child may create his or her own drawing, either independent of the model or with reference to it. In this manner, the model and the picture may be displayed together over the course of a calendar month.

Another object of the present invention resides in permitting a child to prepare a separate artistic work each month throughout a calendar year, and over several years, so that the child is able to observe improvements made over the course of time, and to look back on prior works to measure such improvements.

It is a further object of the present invention to provide an opportunity for a child to create artwork that is relevant to the season, and that may be enjoyed by others by allowing the artwork and calendar to be hung from a refrigerator.

In accordance with these and other objects evident from the following description of a preferred embodiment, a calendar constructed in accordance with the present invention comprises at least twelve pages of a printing material, wherein each page includes a calendar field filled with a series of numbered spaces arranged to indicate the days of a particular month in the Gregorian calendar, a title field provided with alphabetical indicia indicative of the month represented in the calendar field, a display field provided with one or more graphical symbols of an event which occurs within the month represented in the calendar field, and a plain, original artwork field within which alphanumeric and graphical symbols may be drawn by an art student. The original artwork field covers at least one half of the area of each page.

By providing such a calendar, numerous advantages are realized. For example, because each artwork field is associated with a different month of a calendar year, that field may be used to create a seasonal drawing that will demonstrate the child's artistic ability during that particular month, and the entire collection of works created over the course of a year can be easily preserved so that the child may later look back on the drawings to observe the progress made.

BRIEF DESCRIPTION OF THE DRAWING FIGURES

A detailed description of a preferred embodiment of the present invention is described in detail below with reference to the attached drawing figures, wherein:

FIG. 1 is a perspective view of an art kit constructed in accordance with the preferred embodiment of the present invention, illustrating a calendar, crayons and a magnet included in the kit; and FIG. 2 is a plan view of a single page of the calendar.

DETAILED DESCRIPTION OF THE PREFERRED EMBODIMENT

Figure 1:
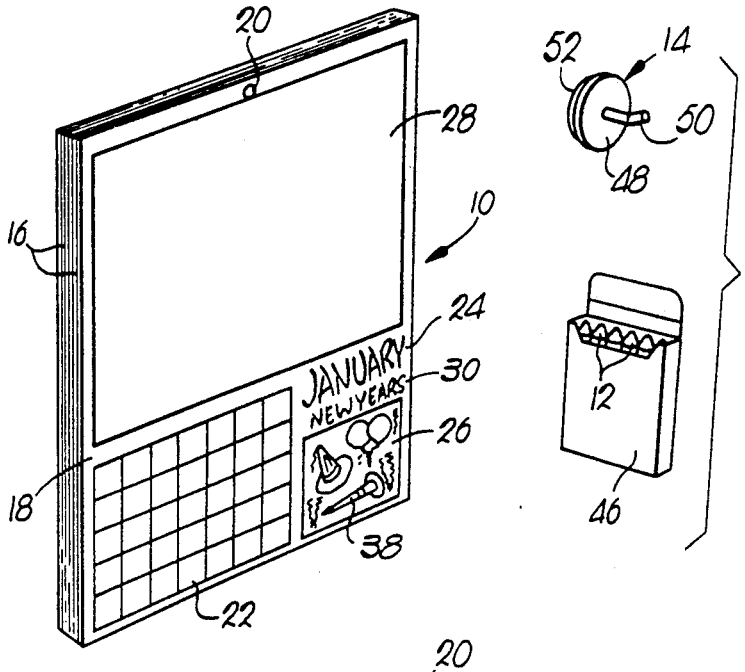

An art kit constructed in accordance with the preferred embodiment of the present invention is shown in FIG. 1, and includes generally a calendar 10, a set of crayons 12, and a magnet 14.

The calendar 10 includes a plurality of sheets 16 of a printing material, e.g. a fibrous material such as paper or the like, which are connected together along the top edges thereof to present a booklet. Either six double-sided or twelve single-sided sheets of the printing material are preferably included in the booklet so that an entire calendar year of the Gregorian calendar system is provided. A hole 20 is formed through the sheets at the center of the upper edge of the booklet, enabling the booklet to be hung from a peg or hook for display purposes.

Figure 2:
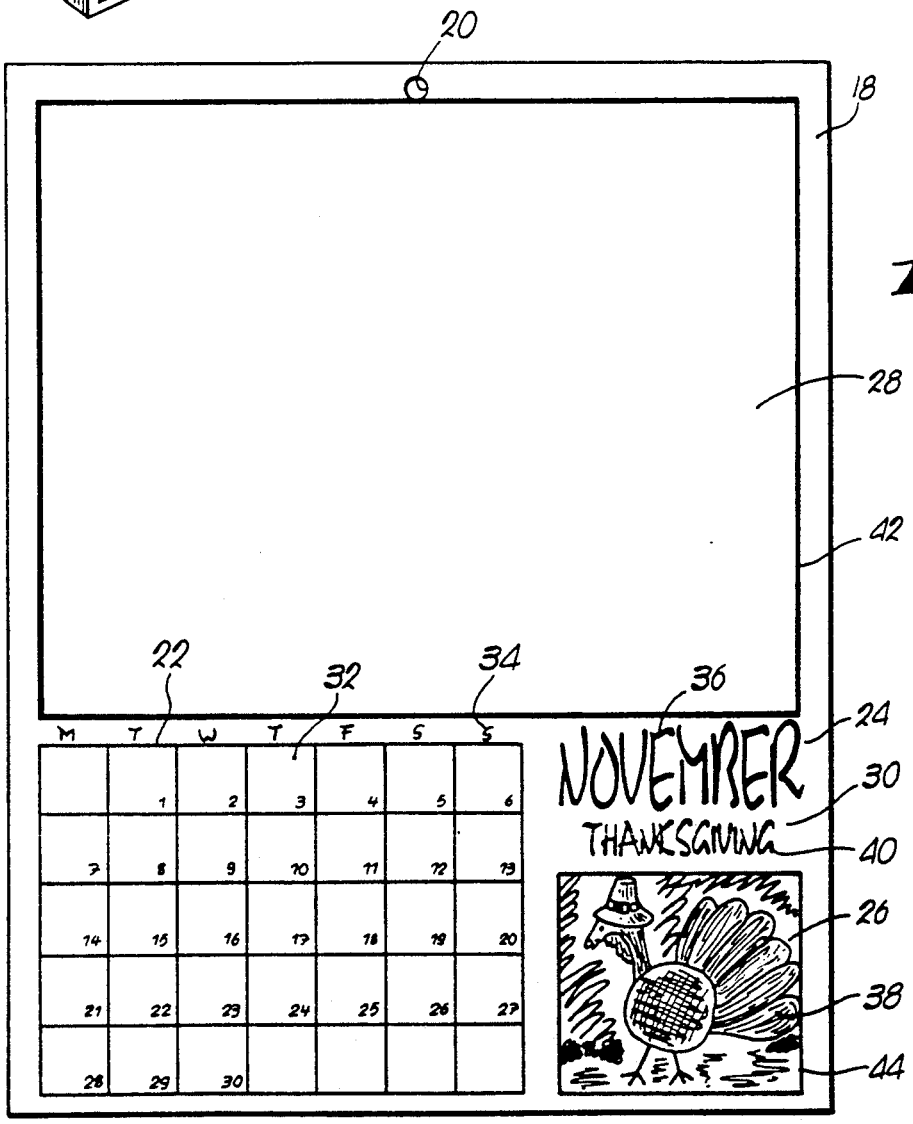

A single page 18 of the calendar 10 is illustrated in FIG. 2. If double-sided sheets are employed, a different page is printed on each side of the sheet. Otherwise, only one page is provided on each sheet so that the back side of the sheets are either blank or used for other purposes, such as for making notes concerning the artwork created on the front page.

The illustrated page 18 includes a calendar field 22 filled with a series of numbered spaces 32 arranged to indicate the days of a particular month in the Gregorian calendar. Preferably, the numbered spaces are squares arranged in seven columns such that each column is representative of a particular day of the week. At the top of each column, suitable indicia 34 are provided for indicating which particular day of the week that column represents.

Each page 18 also includes a title field 24 positioned adjacent the calendar field and provided with alphabetical indicia 36 indicative of the month represented in the calendar field. For example, in the page shown, the numbered spaces 32 are arranged within the columns to represent the month of November for 1994, and the indicia 36 within the title field 24 spell the word "November".

A display field 26 is provided beneath the title field 24 and includes a completed picture with one or more graphical symbols 38 of an event which occurs within the month represented in the calendar field. For example, because Thanksgiving Day is the 24th of November in 1994, a turkey wearing a pilgrim's hat is provided in the display field 26. The complexity of the graphical symbols used in the display field ar comparable to the artistic ability of the average child within the age group to which the calendar is targeted, preferably between the ages of 4 and 12.

Over one-half of the area of the page 18 is occupied by a plain, original artwork field within which alphanumeric and graphical symbols may be drawn by an art student, either with reference to the display field or independent thereof. The original artwork field is substantially free of any printed matter, except for a line 42 delineating the field and defining the borders within which the artist is to complete the work. A line 44 delineates the display field in a similar manner, and defines the borders of the model to be used by the child in preparing artwork within the artwork field.

Thus, in addition to providing a model within the display field for use by the artist in conceiving a design to be produced within the original artwork field, the child is also able to obtain a sense of proportion between the displayed model and the work in progress. This enables both the child and his or her teacher or parent to practice proper composition in the work being created, and to compare the composition of previous works with subsequent ones.

An event field 30 is interposed between the display field 26 and the title field 24. This event field includes alphabetical indicia 40 indicative of the event illustrated in the display field on that particular page, and allows the child to identify the event which is to be the object of the artwork to be created. Where the child is at an age at which reading is being taught, this event field also allows the child to practice reading the name of the event, as well as providing a model for the child so that he or she may write the word over again in the original artwork field.

Returning to FIG. 1, the set of crayons 12 are shown as being collected within a box 46 which may be included with the calendar in a kit. It is important that the colors used in the graphical symbols within the display field be substantially the same as the colors of the crayons included with the kit so that a child interested in copying the graphical symbols of the display field is able to do so without being required to use different colors. For example, if the colors red, yellow, blue, green, orange, brown and black are used in the display field, crayons of these same colors should be provided with the kit.

The magnet 14 is also illustrated in FIG. 1, and includes a backing plate 48 and a protruding hook 50 connected to one side of the backing plate and extending outward in a direction transverse to the plate. A piece of magnetic material 52 is attached to the backing plate 48 opposite the hook 50, and enables the magnet 14 to be secured to a metallic surface, such as the door of a refrigerator or the like. The hook 50 is sized for receipt within the hole 20 in the sheets 16 of the calendar so that when the calendar is turned to the proper page, it may be hung from the hook on the refrigerator.

In use, the magnet is positioned in a convenient location on the child's home refrigerator, and the calendar is hung from the hook to display the present month. At the beginning of each new month, the calendar is taken down from the refrigerator so that the child is able to turn the page to the next present month and prepare artwork related to a particular event occurring within that month. Thus, at the end of the year, the child will have an accurate record of the artwork completed during the year in connection with the calendar. In addition, this artwork will be retained within the booklet so that the child may return to the works years later and be able to observe his or her artistic efforts, with knowledge of the exact month within which the work was originally created.

In addition to providing a valuable means for measuring artistic progress, the inventive calendar also presents an attractive archive that may be enjoyed throughout the artist's life.

Although the present invention has bee described with reference to the preferred embodiment illustrated in the attached drawing figures, it is noted that equivalents may be made and substitutions employed herein without departing from the scope of the invention as recited in the claims.

What is claimed is:

1. A calendar comprising:

at least twelve pages of a printing material, each page including a calendar field filled with a series of numbered spaces arranged to indicate the days of a particular month in the Gregorian calendar, a title field provided with alphabetical indicia indicative of the month represented in the calendar field, a display field provided with one or more graphical symbols of an event which occurs within the month represented in the calendar field, and a plain, original artwork field within which alphanumeric and graphical symbols may be drawn by an art student, wherein the original artwork field covers at least one half of the area of each page.

2. A calendar as recited in claim 1, wherein each page further includes an event field provided with alphabetical indicia indicative of the event indicated in the display field on that page.

3. A calendar as recited in claim further comprising at least six sheets of printing material, wherein one of the pages is provided on each side of the sheet.

4. A calendar as recited in claim 1, further comprising a plurality of markers, each of different color, wherein the graphical symbols in the display fields are of the same color as the colors of the markers so that the art student may duplicate the graphical symbols in the display fields within the original artwork fields.

5. A calendar as recited in claim 1, further comprising indicia delineating the original artwork field so that the area of the original art field is defined for the art student.

6. A calendar as recited in claim 3, further comprising a hook and a piece of magnetic material affixed to the hook, the sheets each including a hole through which the hook is able to pass in order to permit the apparatus to be supported by the hook when the hook is held by magnetic force to a metallic surface.

* * * * *